US006814645B2

(12) United States Patent
Kuk

(10) Patent No.: US 6,814,645 B2
(45) Date of Patent: Nov. 9, 2004

(54) HULA HOOP

(76) Inventor: Tae-Il Kuk, 72 Pung-Dong, Ilsan-Ku, Koyang, 411-330 Kyounggi-Do (KR)

( * ) Notice: Subject to any disclaimer, the term of this patent is extended or adjusted under 35 U.S.C. 154(b) by 75 days.

(21) Appl. No.: 10/468,614

(22) PCT Filed: Nov. 21, 2001

(86) PCT No.: PCT/KR01/02000

§ 371 (c)(1),
(2), (4) Date: Aug. 21, 2003

(87) PCT Pub. No.: WO02/068079

PCT Pub. Date: Sep. 6, 2002

(65) Prior Publication Data

US 2004/0077270 A1 Apr. 22, 2004

(30) Foreign Application Priority Data

Feb. 27, 2001 (KR) ..... 200110114
Aug. 30, 2001 (KR) ..... 200153041

(51) Int. Cl.[7] ..... A63H 1/00
(52) U.S. Cl. ..... 446/236; 446/28; 601/132; 482/132

(58) Field of Search ..... 446/236, 28, 26; 482/132, 131, 110, 105, 43; 601/121, 131, 132; 434/247, 250

(56) References Cited

U.S. PATENT DOCUMENTS 3,178,851 A * 4/1965 Gage ..... 446/28
3,509,660 A * 5/1970 Seymour ..... 446/38
3,729,860 A * 5/1973 Kargul ..... 446/236
3,899,115 A * 8/1975 Simjian ..... 601/132
4,052,982 A * 10/1977 Ozeryansky ..... 601/121
4,836,818 A * 6/1989 Piolata ..... 446/236
5,492,526 A * 2/1996 Chen ..... 601/132

* cited by examiner

*Primary Examiner*—Derris H. Banks
*Assistant Examiner*—Bena B. Miller
(74) *Attorney, Agent, or Firm*—Allen, Dyer, Doppelt, Milbrath & Gilchrist, P.A.

(57) ABSTRACT

A hula hoop may include a hoop, a plurality of roller members being installed on a predetermined portion in an overall circumference of the hoop, and a weight member being installed on an opposite side to the center of the roller members to provide a centrifugal force and enable rollers comprised in the roller members to be closely contacted with and rolled on a user's body due to the centrifugal force.

20 Claims, 17 Drawing Sheets

HULA HOOP

TECHNICAL FIELD

The present invention relates to a hula hoop, and more particularly, to a hula hoop consisting of a plurality of roller members being installed on a predetermined portion in an overall circumference of the hoop and a weight member being installed on an opposite side to the center of the roller members to provide a centrifugal force to the hoop, wherein when a user spins the hula hoop around the waist, the weight member is always positioned farthest from the user's body due to the centrifugal force of the weight member while the hula hoop is twirled, and rollers included in the roller members are closely contacted with and rolled on the user's body portions, thereby achieving exercise effect for the waist and lower part of the body and dissolving the user's fat on the waist, sides and belly portions.

The inventors obtained the idea for the present invention seeing women who make their calves slender by rolling round objects including bottles, such as beer bottles, hard liquor bottles, etc., on their calves to remove unwanted fat thereon.

BACKGROUND ART

Technology disclosed in Korea utility model registration number 20-0173072 filed on Dec. 16, 1999, Korea utility model registration number 20-0165194 filed on Oct. 14, 1999 and utility model publication number 1992-0008434 filed on Nov. 30, 1992 teaches a hula hoop which can improve exercise effect for the waist simply by forming a weight member on the hoop to increase a centrifugal force and applying a strong impact to the user's waist which is the center of turning.

Further, Korea patent publication number 2000-0072016 filed on Dec. 5, 2000 and patent publication number 2000-0063372 filed on Nov. 6, 2000 disclose a hula hoop in which rotary projections or rotary balls are formed on an overall inner circumference to give a massaging effect to a user's waist as well as exercising the waist. The hula hoop, however, has a disadvantage that even though the hoop is twirled due to a centrifugal force generated by turning thereof, the rotary projections or the rotary balls are barely spun in practice and just slightly compress predetermined portions of the user's body due to the centrifugal force of the hoop. Accordingly, the projections in the conventional art are almost the same as stationarily installed on the overall inner circumference of the hoop.

DISCLOSURE OF INVENTION

An object of the present invention is to provide a hula hoop capable of exercising a user's waist including a plurality of roller members on a predetermined portion in an overall circumference of the hoop and a weight member opposite in location to the center of the roller members to provide a centrifugal force of the hoop, wherein when the hoop is twirled around the user's body, due to the strong centrifugal force of the weight member. The overall circumference of the hoop is not contacted with a user's waist, side and belly portions but only rollers installed on the predetermined portions are contacted with the user's body and accordingly rollers which are closely contacted with the body are rolled, in contrast to the conventional hula hoop in which the overall circumference of the hoop is brought into contact with the user's body.

Another object of the present invention is to provide a hula hoop capable of dissolving unwanted fat by enabling the rollers to continuously press and pass the user's body while being spun.

Yet another object of the present invention is to provide a hula hoop capable of giving more pleasure and effect compared with the conventional hula hoop whose overall inner circumference is contacted with the user's both sides, belly and waist.

Still another object of the present invention is to provide a hula hoop capable of enhancing product value by installing the rollers and the weight member to variously design an outward appearance of the hoop.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a hula hoop comprising a hoop; a plurality of roller members being installed on a predetermined portion of an overall circumference of the hoop; and a weight member being installed opposite in location to the center of the roller members to provide a centrifugal force and permitting rollers comprised in the roller members to be closely contacted with and rolled on a user's body.

In another aspect of the present invention, a hula hoop comprises a hoop which is adjustable in size by coupling a first hoop and a second hoop with length adjusting screws; a plurality of roller members being installed on the second hoop; and a weight member being installed on the fist hoop on an opposite side to the center of the roller members installed on the second hoop to provide a centrifugal force to the hoop and permitting rollers comprised in the roller members to be closely contacted with and rolled on a user's body due to the centrifugal force.

The roller members individually include a pair of inter-supports being fixed on the hoop and a roller being rotatably fixed on the inter-support with a pin.

Pairs of chain-type inter-supports of the roller members are connected via the pins to form a chain. One roller is installed between one pair of chain-type inter-supports to be axially rotatable.

The roller members are installed to be separable from the hoop.

The rollers of the roller members are individually provided with pressure projections.

Contents of the weight member is water.

Contents of the weight member is sand.

The hoop has a shape selected from the group consisting of circular, oval, D-, triangular, and polygonal shape.

The hoop may be used as a massaging unit by separating the roller members from the hoop and installing handles on both ends of the roller members.

It is to be understood that both the foregoing general description and the following detailed description of the present invention are exemplary and explanatory and are intended to provide further explanation of the invention as claimed.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Reference will now be made in detail to the preferred embodiments of the present invention, examples of which are illustrated in the accompanying drawings.

Figure 1:
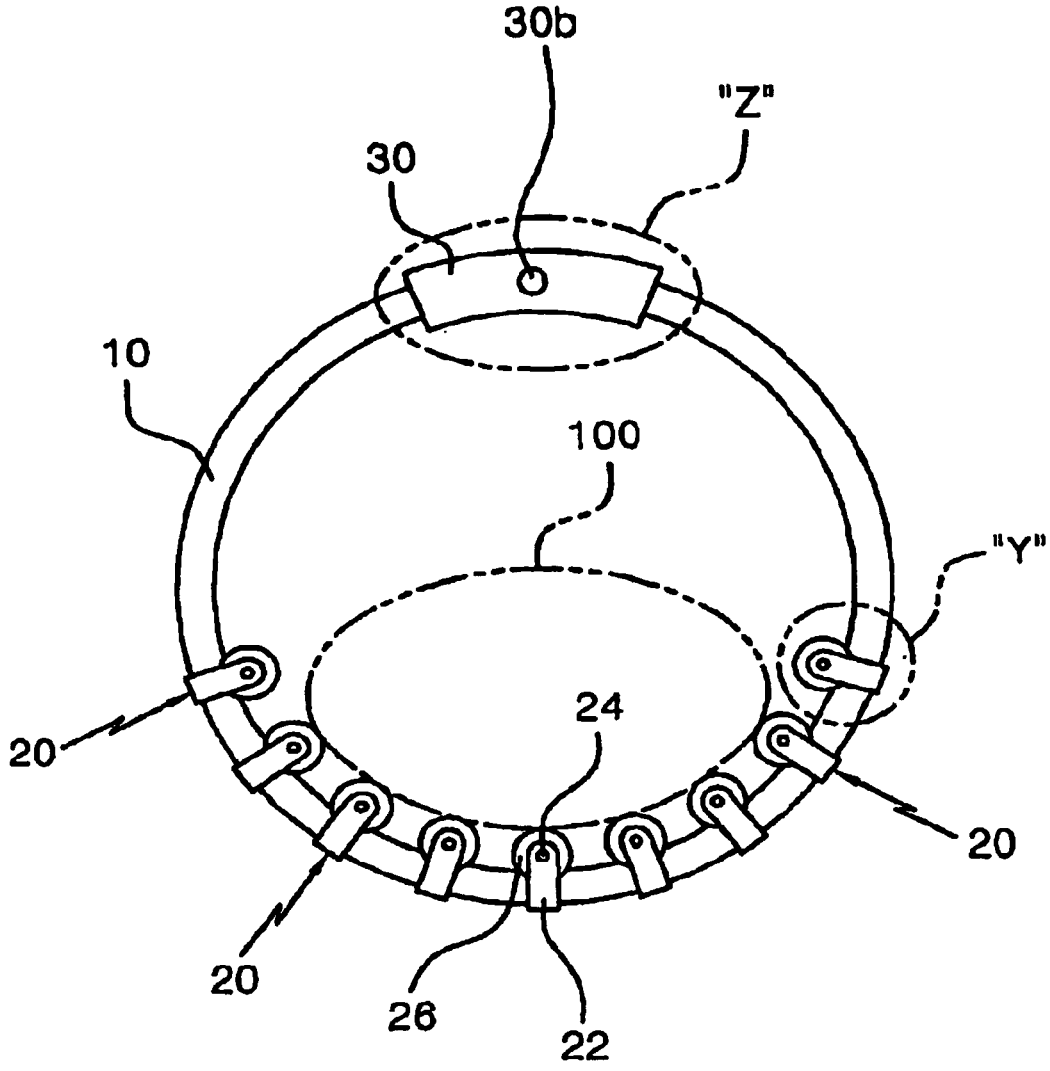
FIG. 1 is a front view of a hula hoop according to a preferred embodiment of the present invention.
Figure 2:
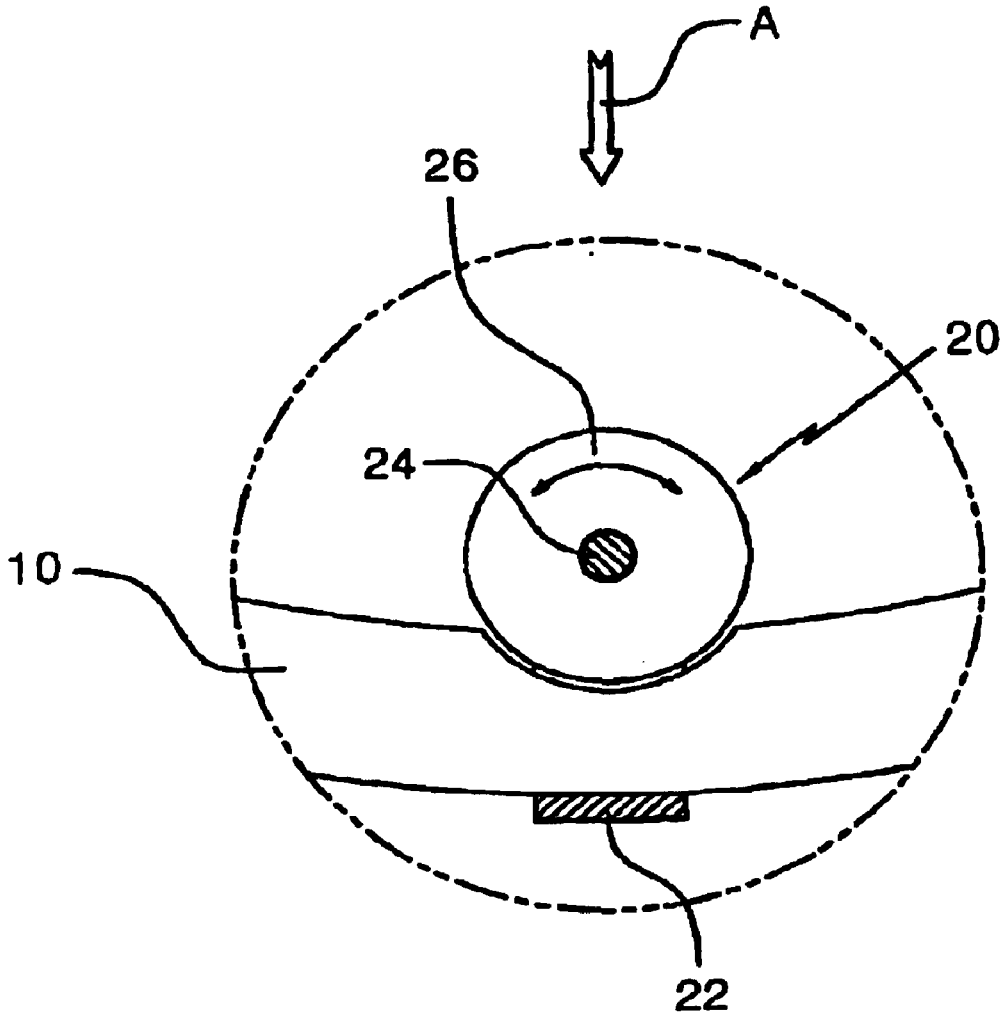
FIG. 2 is a detailed view of a part Y of FIG. 1.
Figure 3:
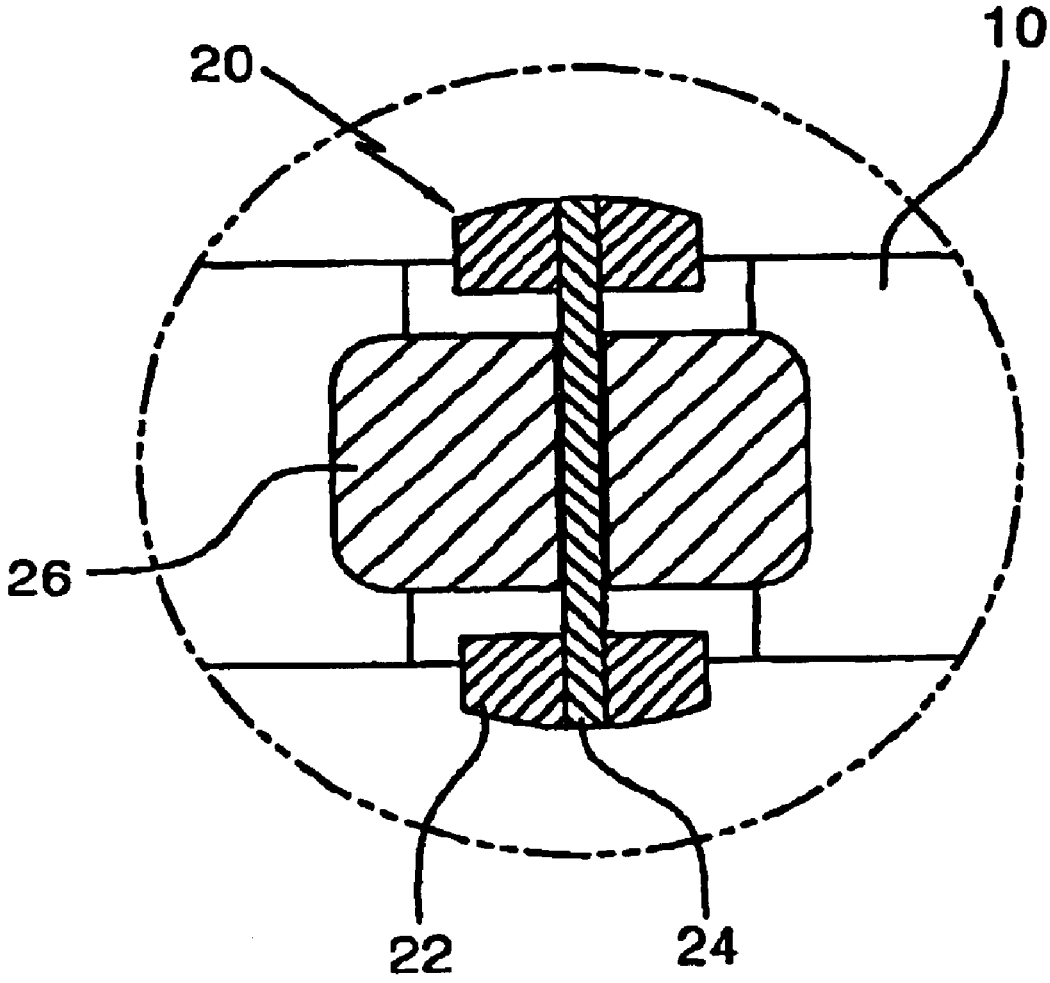
FIG. 3 is a detailed and sectional view taken in a direction A of FIG. 2.

Referring to FIG. 1 illustrating a preferred embodiment of the present invention, a hoop 10 has a ring-shape materialized of plastics having a hollow portion at an inside thereof. The hoop 10 is generally dissemblable into a plurality of parts to facilitate carrying at needs and assemblable with general screw means.

The hoop exemplarily takes the circular shape but may take other shapes, e.g., quadrangular shape or polygonal shape, according to designs.

A plurality of roller members 20 are equi-distantly installed on a predetermined portion of an overall circumference of the hoop 10. A weight member 30 is installed on an opposite side to the center of the roller members 20 to provide a centrifugal force to the hoop 10 and enable rollers 26 comprised in the roller members 20 to be closely contacted with and rolled on a user's body.

The roller members individually include inter-supports 22 being fixed on the hoop 10 and the roller 26 being rotatably fixed on the inter-supports 22 with a pin 24.

Figure 12:
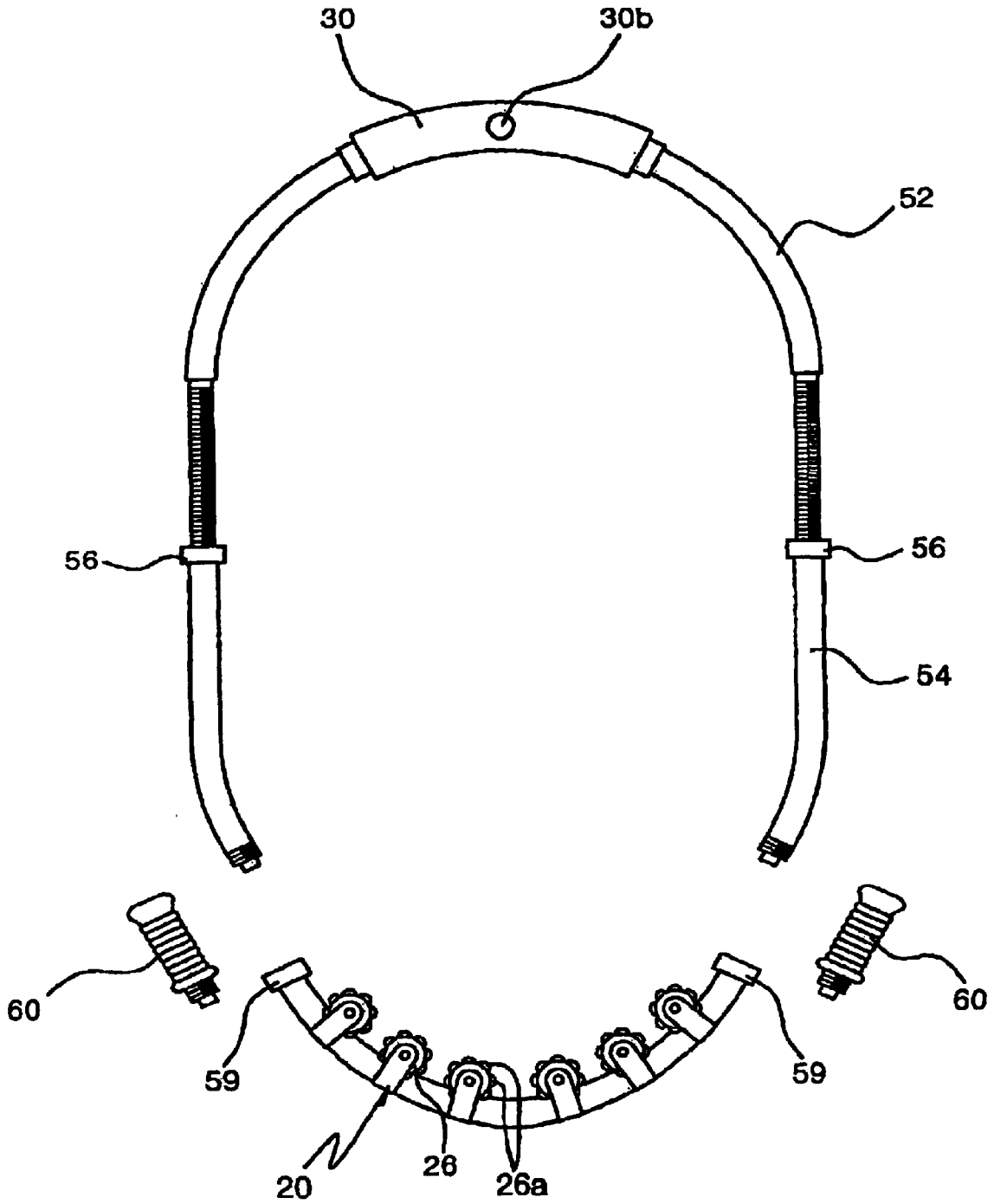
FIG. 12 is a front view of a partially separated hula hoop according to yet another preferred embodiment of the present invention.

The roller 26 exemplarity takes a roll-type but may take a spherical shape (not shown). As shown in FIG. 12, the roller 26 may be provided with pressure projections 26*a* therearound.

Figure 4:
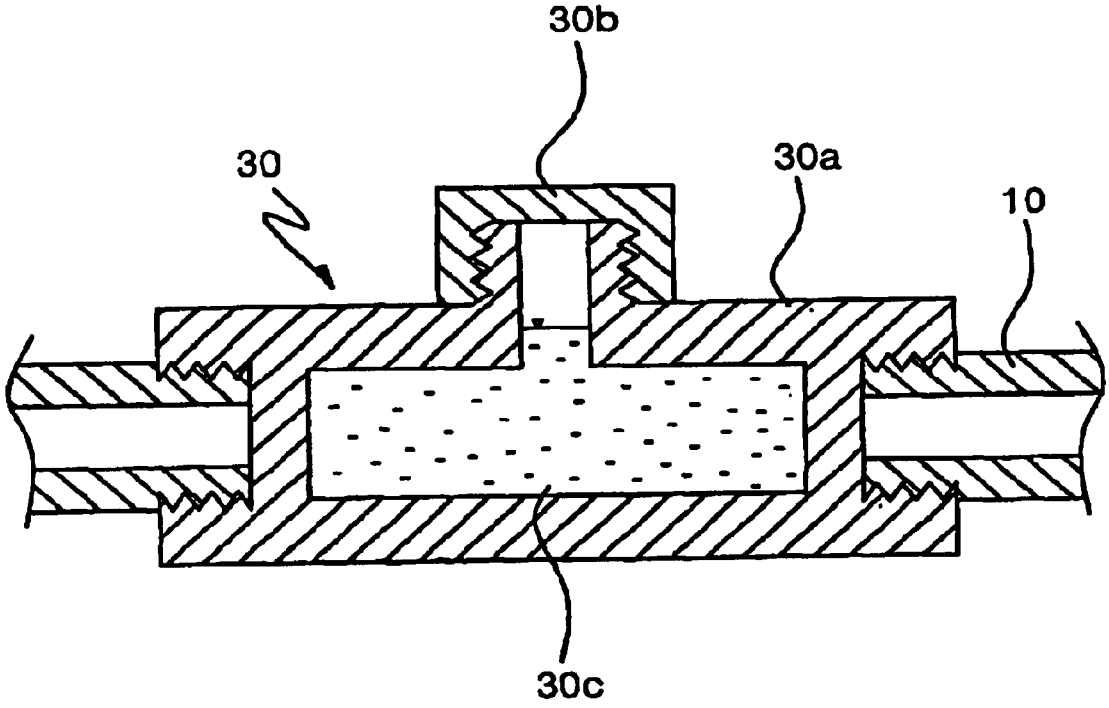
FIG. 4 is a detailed and sectional view of a part Z of FIG. 1.
Figure 5A:
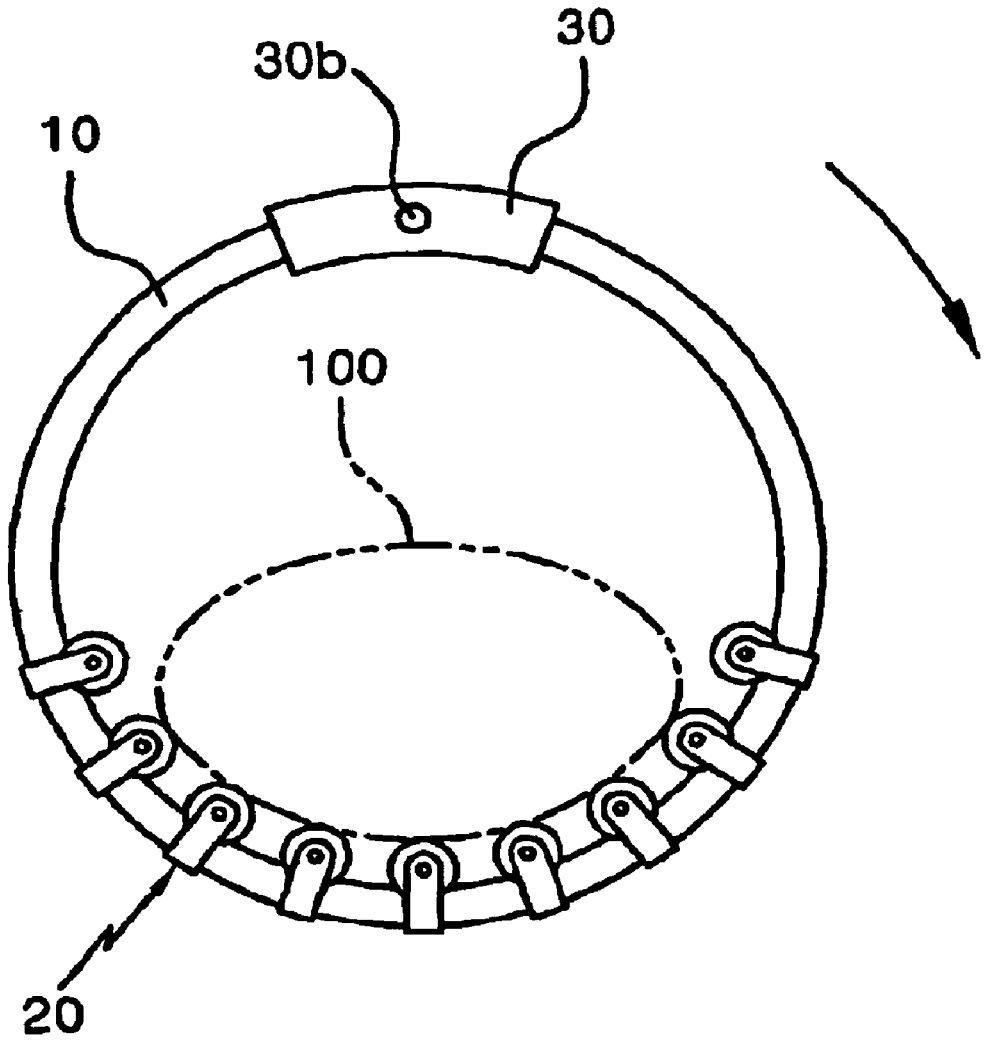
FIGS. 5A, 5B, 5C and 5D are views illustrating a state where the hula hoop is at work according to the present invention.
Figure 5B:
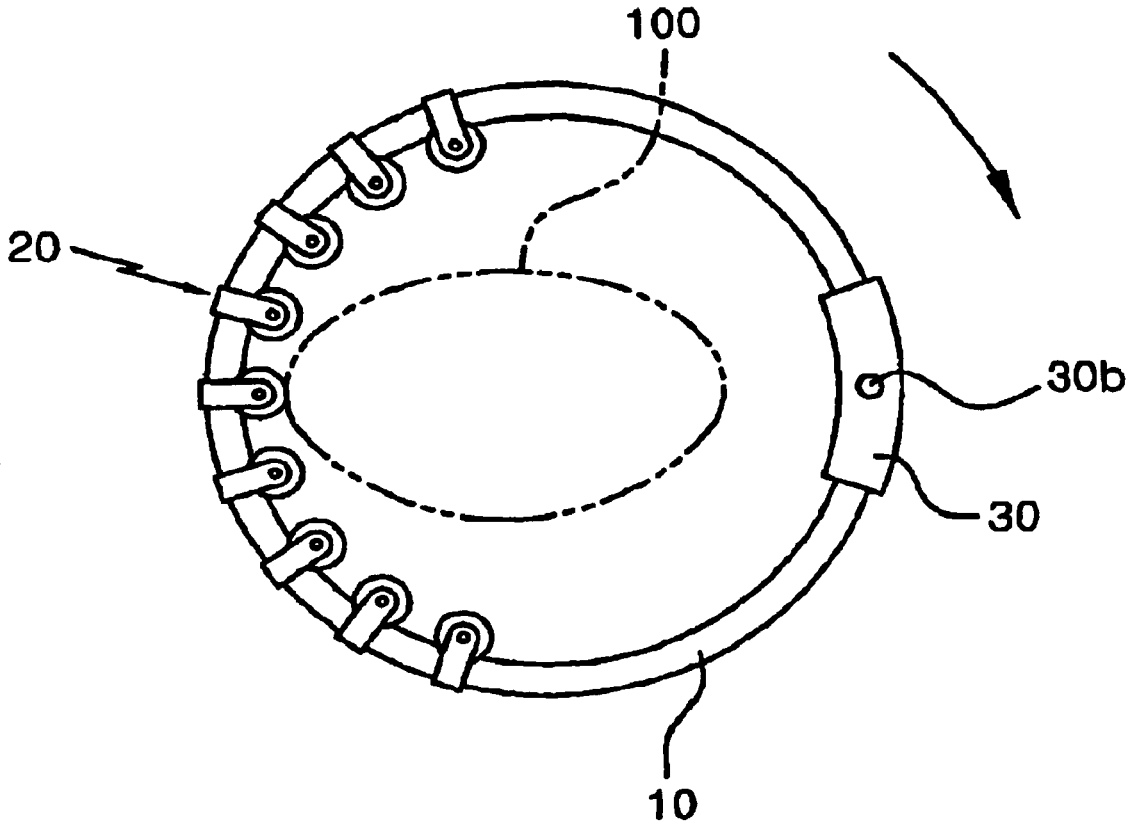
Figure 5C:
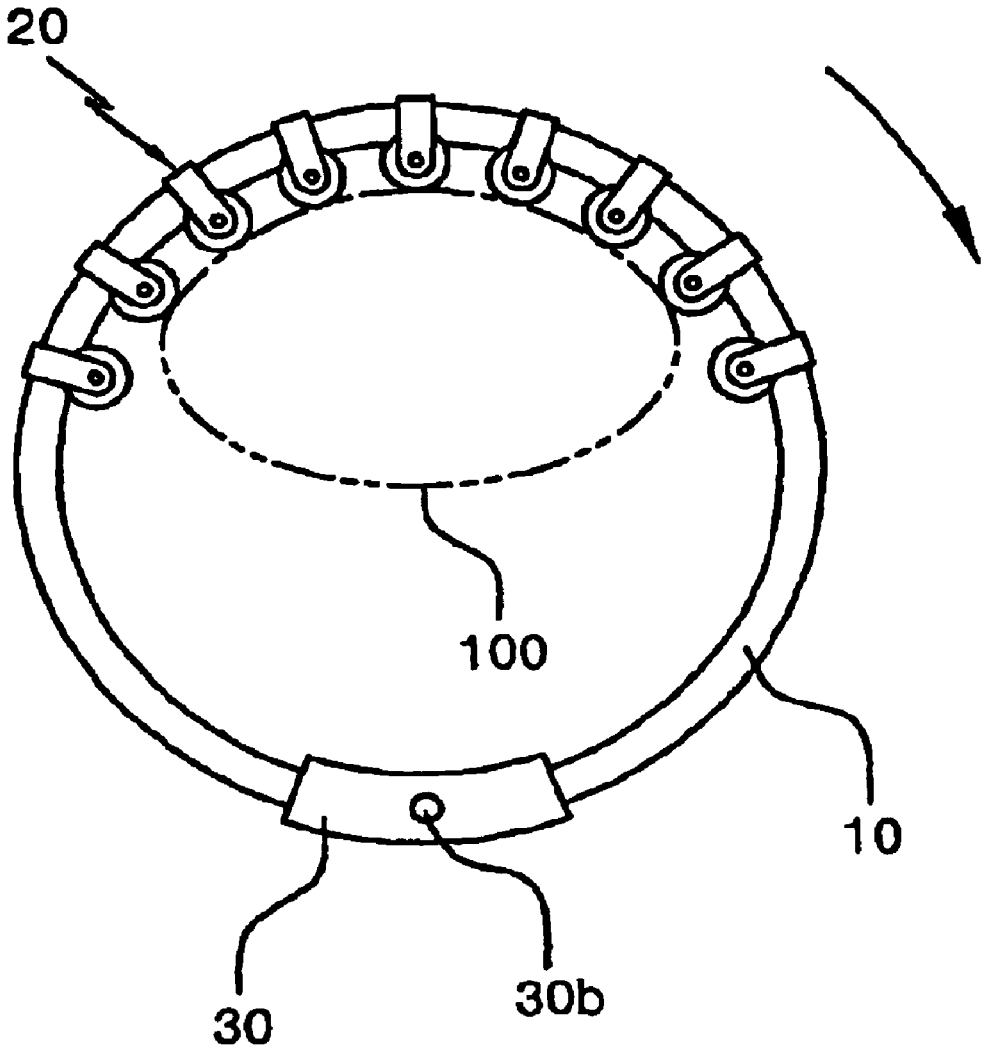
Figure 5D:
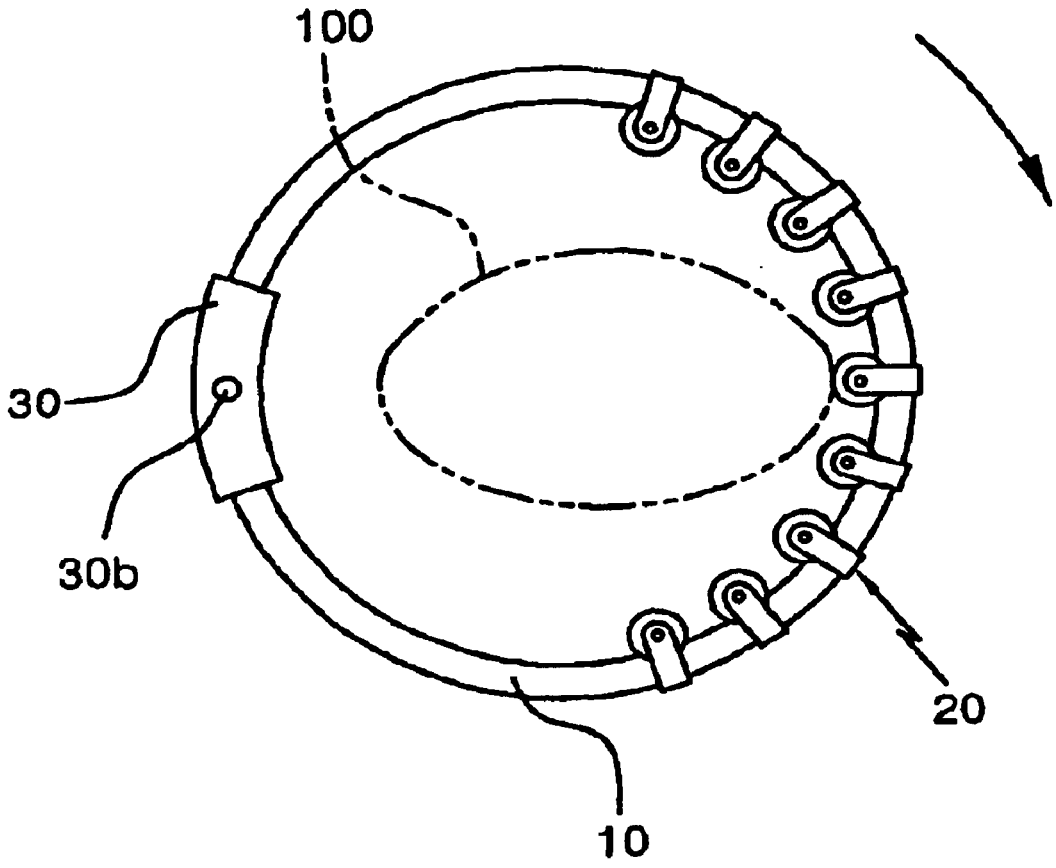

As drawn in FIG. 4, the weight body 30 permits both sides of a case 30*a* to be coupled with the hoop 10 with screws. A plug 30*b* is installed on the case 30*a* and allows water 30*c* to be filled therethrough as contents of the weight member.

Alternatively, sand may be substituted for the water as contents of the weight member but has a difficulty in filling the case therewith.

According to the present invention constructed as above, the hoop 10 is used in a manner that the hoop 10 is placed on the user's waist 100, the roller members 20 interiorly installed on the predetermined portion of the hoop 10 are positioned on the user's waist and then the hoop 10 is twirled as the user applies a momentum and a reaction to the waist 100. As illustrated in FIGS. 5A, 5B, 5C and 5D, while the user twists the hoop 10 around the waist 100, the weight member 30 is always located farthest from the waist 100 due to the centrifugal force of the weight member 30. At this time, the rollers 26 comprised in the roller members 20 are closely contacted with and rolled on the waist 100 so as to be spun while pressing the waist, sides and belly.

Accordingly, the rollers 26 make close contact with the waist, the sides and the belly in due order and rolled there without separation from the user's body, thereby achieving the same effect in dissolving unwanted fat at the user's body portions as if women use round objects including bottles for fitness effect and roll them on their calves. Further, the user can take exercise for the lower body as well as the waist and enjoy new pleasure since only the rollers 26 are brought into contact with the body.

Figure 6:
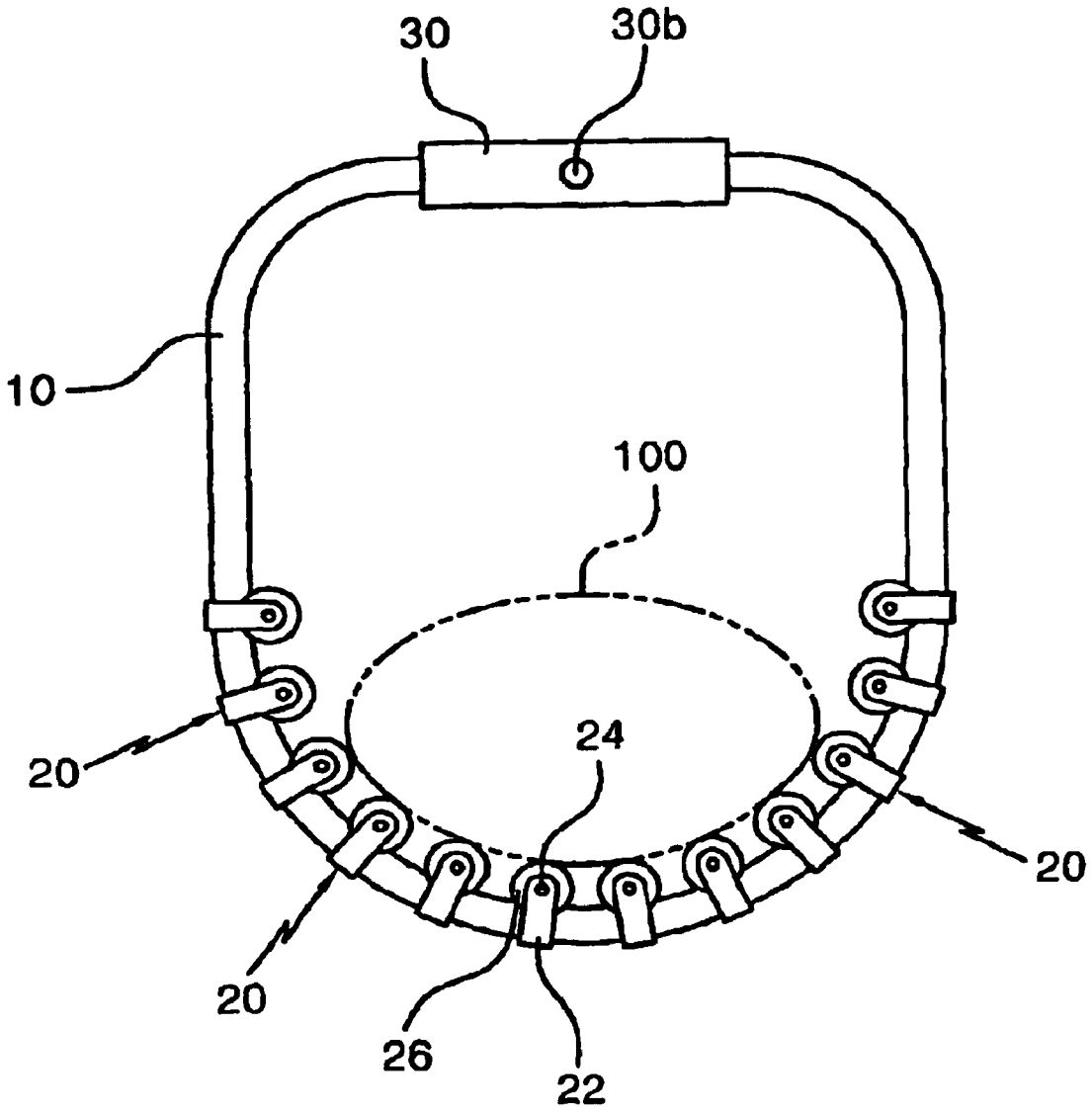
FIG. 6 is a front view of a hula hoop according to another preferred embodiment of the present invention.
Figure 7:
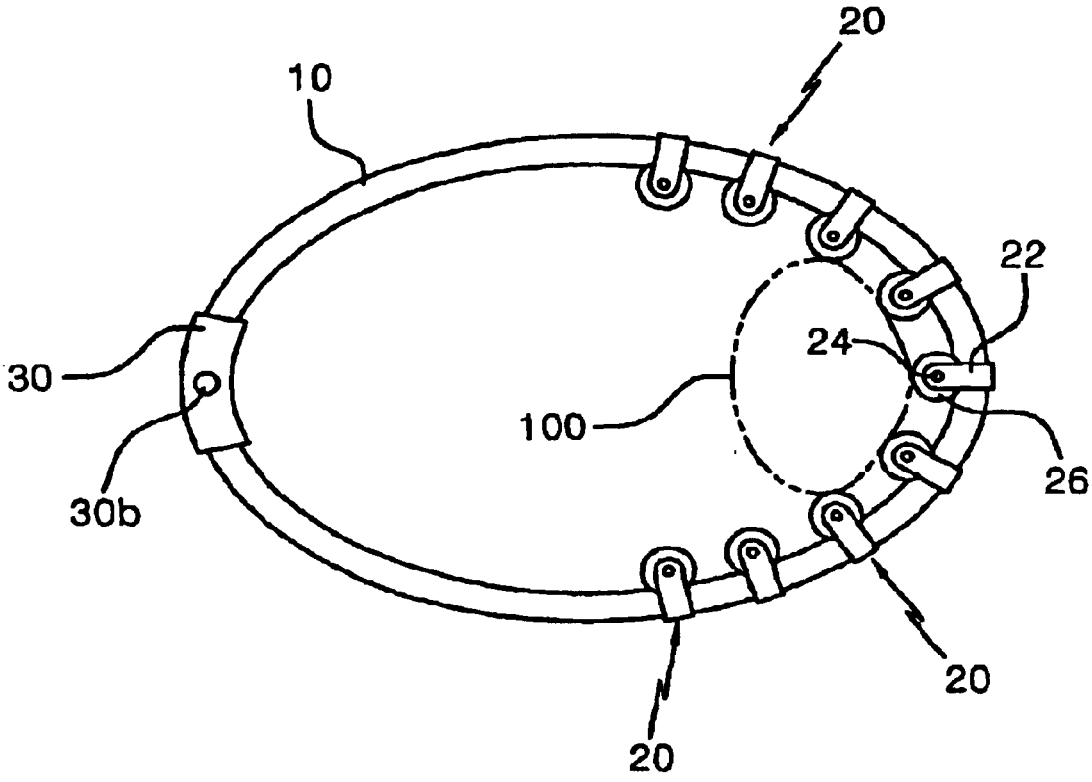
FIG. 7 is a front view of a hula hoop according to yet another preferred embodiment of the present invention.

Meantime, FIG. 6 and FIG. 7 are front views of hula hoops according to another preferred embodiment of the present invention.

FIG. 6 illustrates a D-shaped hoop 10. The roller members 20 are formed inside an arc part of the hoop 10, and the weight member 30 is installed on linear parts connected to both sides of the arc part.

FIG. 7 illustrates an oval hoop 10, which is similar in construction to the circular hoop 10 of FIG. 1.

As stated, the hoop 10 may have the D-shape by additionally installing the roller members 20 and the weight member 30 on the conventional hoop. This is possible because only the rollers 26 come into contact with the user's body when the hoop 10 is at work.

By way of example, a triangular hoop (not shown) is used by making a vertex portion bow-shaped, installing the roller members 20 on the bow-shaped vertex portion and installing the weight member 30 on a side portion of the triangular hoop opposite in location to the center of the roller members 20.

The hoops illustrated in FIGS. 6 and 7 and other heart-, triangular-, quadrangular-, and polygonal-shaped hoops which are not shown may be disassembled into a plurality of parts and assembled with conventional coupling means in a conventional manner in order to facilitate carrying at needs.

As a consequence, product value can be enhanced since the hoop 19 can take various shapes according to a variety of designs.

Figure 8:
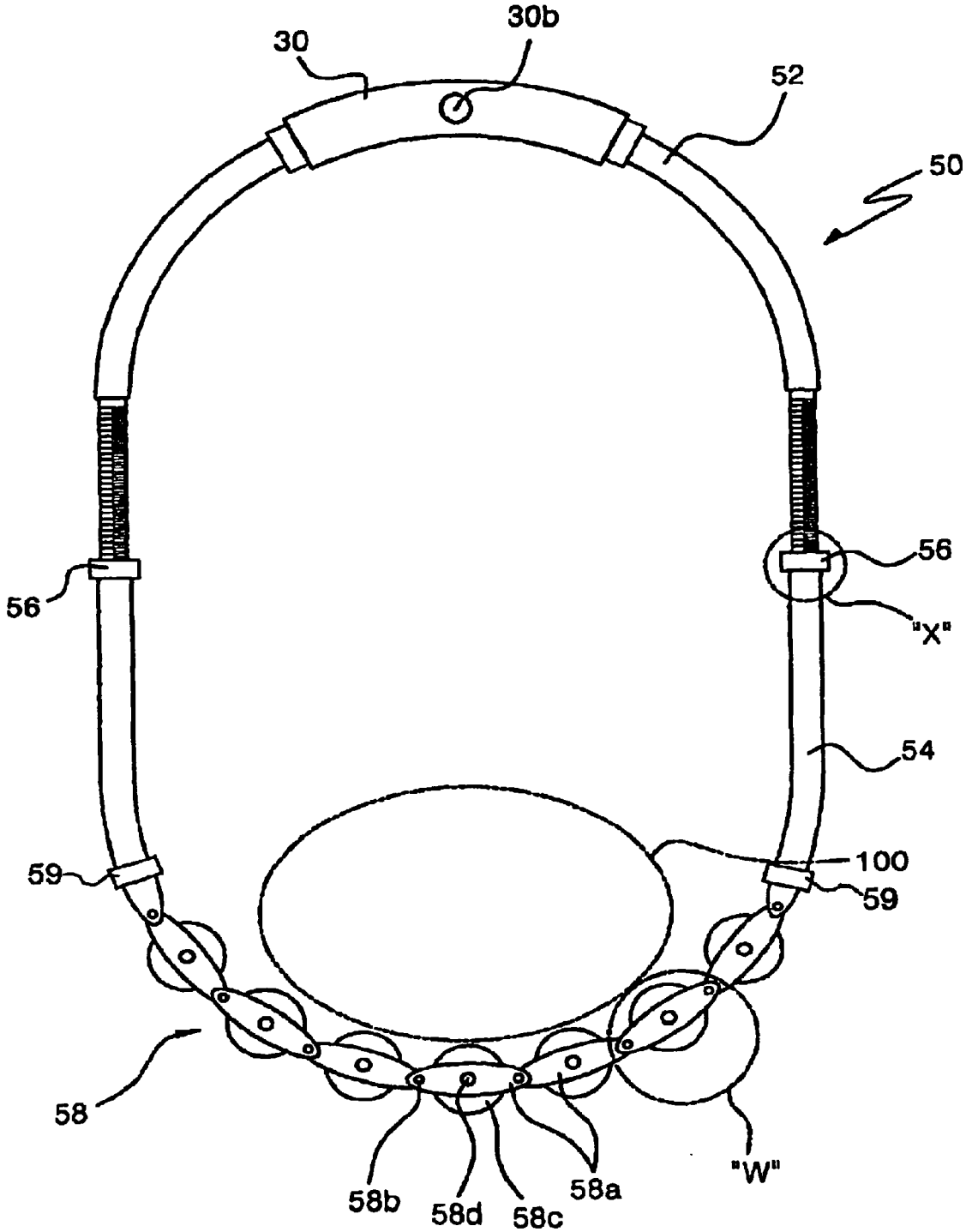
FIG. 8 is a front view of a hula hoop according to still another preferred embodiment of the present invention.
Figure 9:
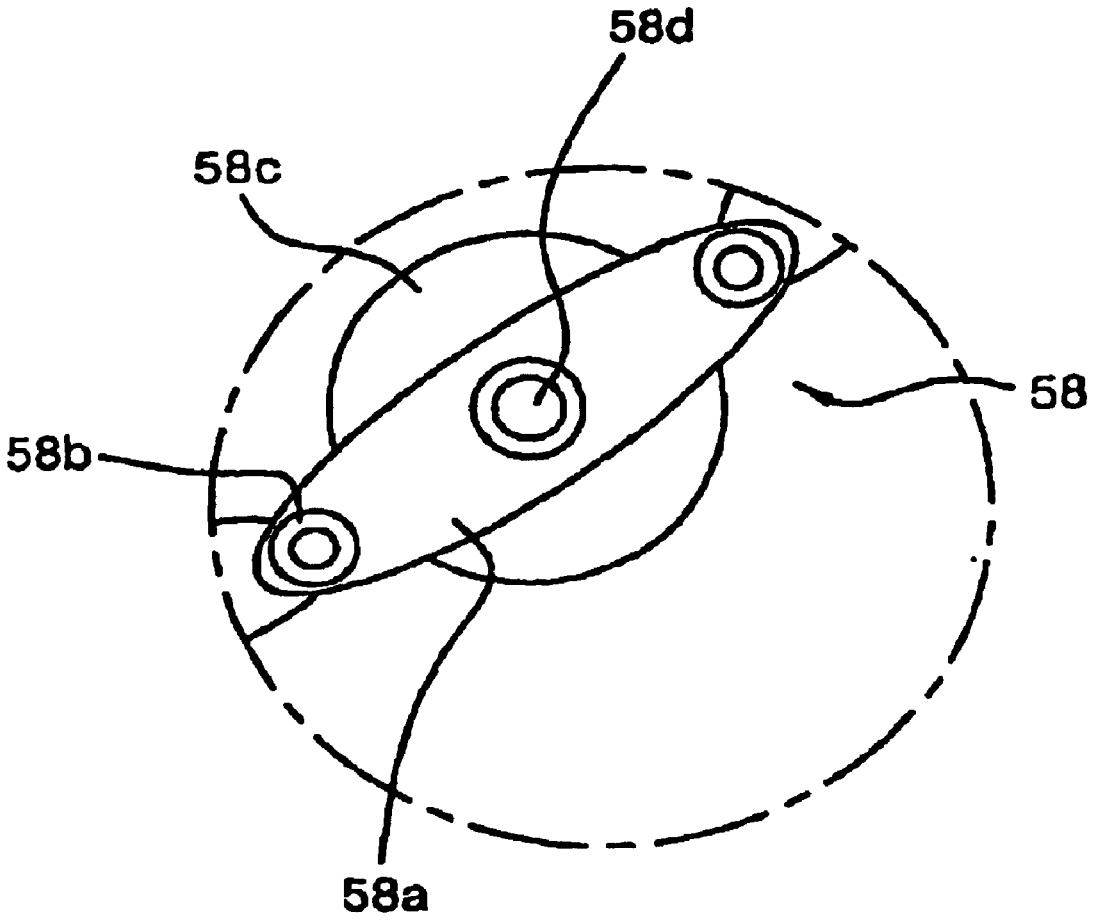
FIG. 9 is a detailed view of apart of FIG. 8.

FIG. 8 and FIG. 9 are views of a hula hoop according to still another preferred embodiment of the present invention.

The hoop 50 is composed of a first hoop 52 and a second hoop 54. The first hoop 52 and the second hoop 54 are coupled with each other by means of length adjusting screws 56 and an overall circumferential size of the hoop is adjustable by virtue of the length adjusting screws 56.

Figure 11:
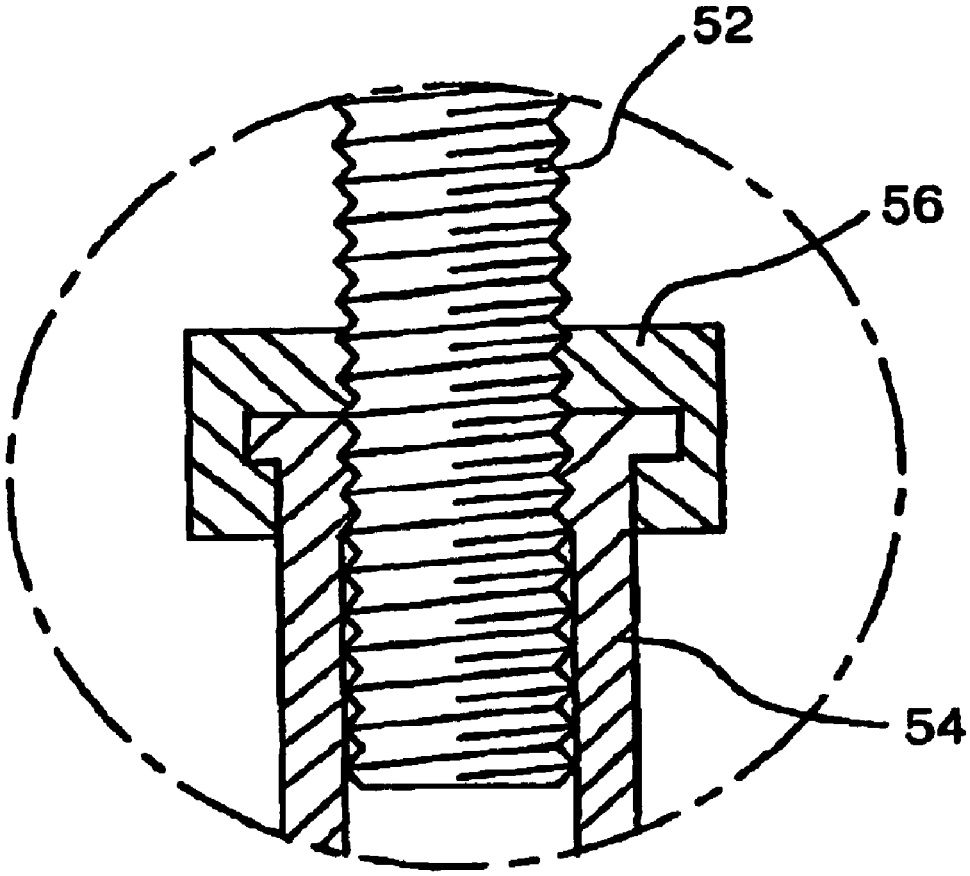
FIG. 11 is a sectional view of apart X of FIG. 8.

That is to say, as shown in FIG. 11, the fist hoop 52 and the second hoop 54 which are coupled by means of the length adjusting screws 56 are adjustable in length by normally and adversely turning the length adjusting screws 56, with a result of adjustment in the circumferential size of the hoop.

A plurality of roller members 58 are installed on the second hoop 54 with nuts 59. The weight member 30 is installed on the first hoop 52 on the opposite side to the center of the roller members 58 which are installed on the second hoop 54 to provide the centrifugal force to the hoop 50.

Figure 10:
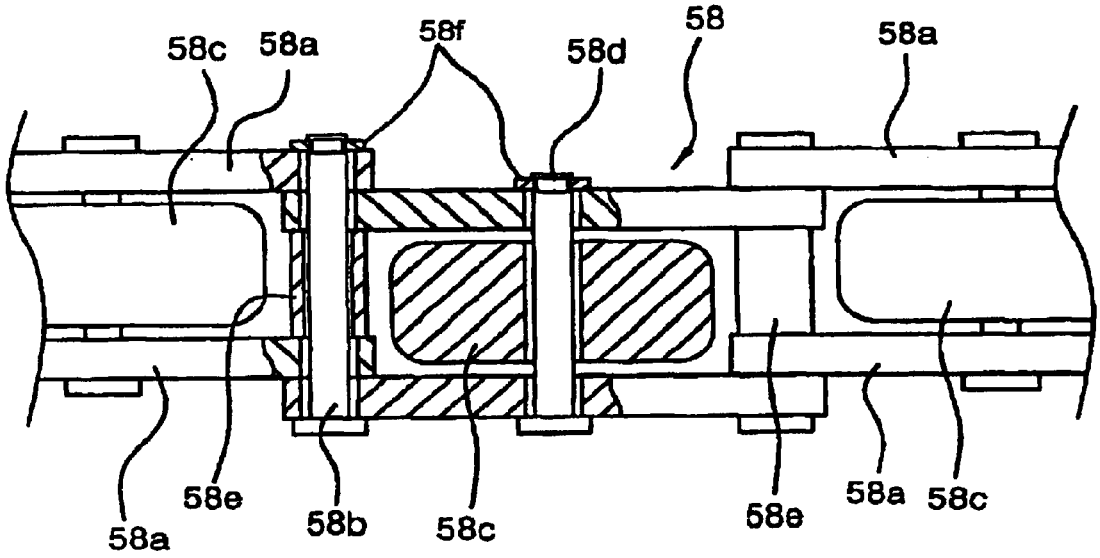
FIG. 10 is a sectional view of FIG. 9.

The roller members 58, as described in FIG. 9 and FIG. 10, form a chain where a pair of chain-type inter-supports 58*a* are connected with pins 58*b*. A roller 58*c* is installed between the pair of chain-type inter-supports 58*a* to be axially rotatable.

The reference numeral 58*e* is a collar for maintaining an interval between the pair of chain-type inter-supports 58*a* and the reference numeral 58*f* signifies a retaining ring.

According to the present invention constructed as above, the user uses the hoop 50 around the waist 100 in a manner that the weight member 30 is always located farthest from the waist 100 due to the centrifugal force of the weight member 30. At this time, the chain-type inter-supports 58*a* of the roller members 58 connected in the chain form are moved due to the centrifugal force, so that the contact power of the rollers applied on the body can be further enhanced.

Additionally, enhancement in exercise effect can be achieved by adjusting size of the hoop 50 by means of the length adjusting screws 56 to increase the centrifugal force generated by the weight member 30.

FIG. 12 is a view of a hula hoop according to yet another preferred embodiment of the present invention. The roller members 20 are separated from the second hoop 54 via the nuts 59, and handles 60 are installed whereby the hula hoop is usable as a separate massaging unit as drawn in FIG. 13.

Figure 13:
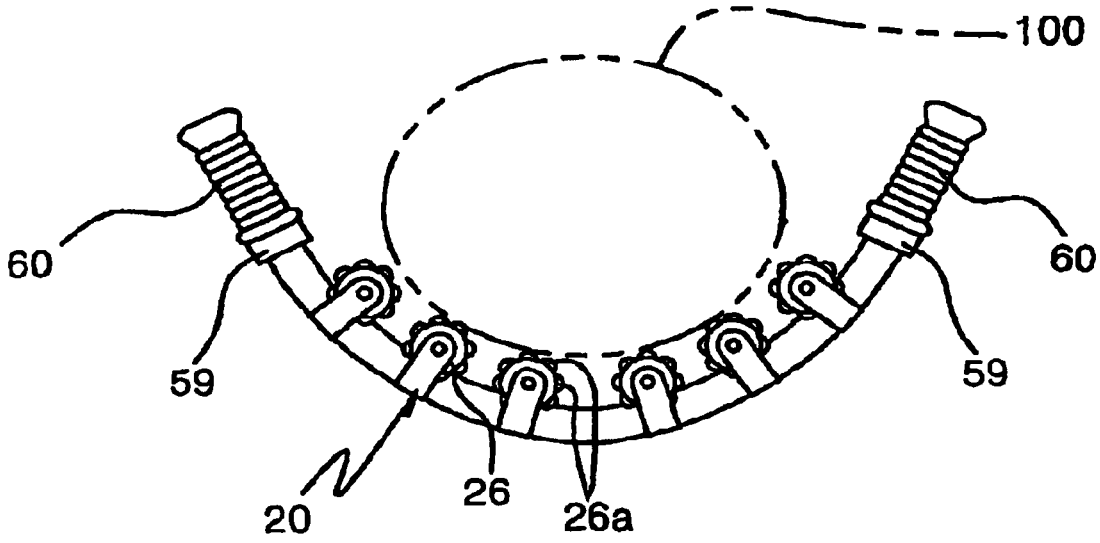
FIGS. 13 and 14 are exemplary views of a use of a hula hoop into a massaging unit.

That is to say, as shown in FIG. 13, exercise effect for the back and waist or the neck can be attained by grasping the handles 60 with both hands and rolling the roller members 20 on the back and waist 100 or the neck At that point, the pressure effect can be more enhanced by forming the pressure projections 26*a* on the rollers 26.

Figure 14:
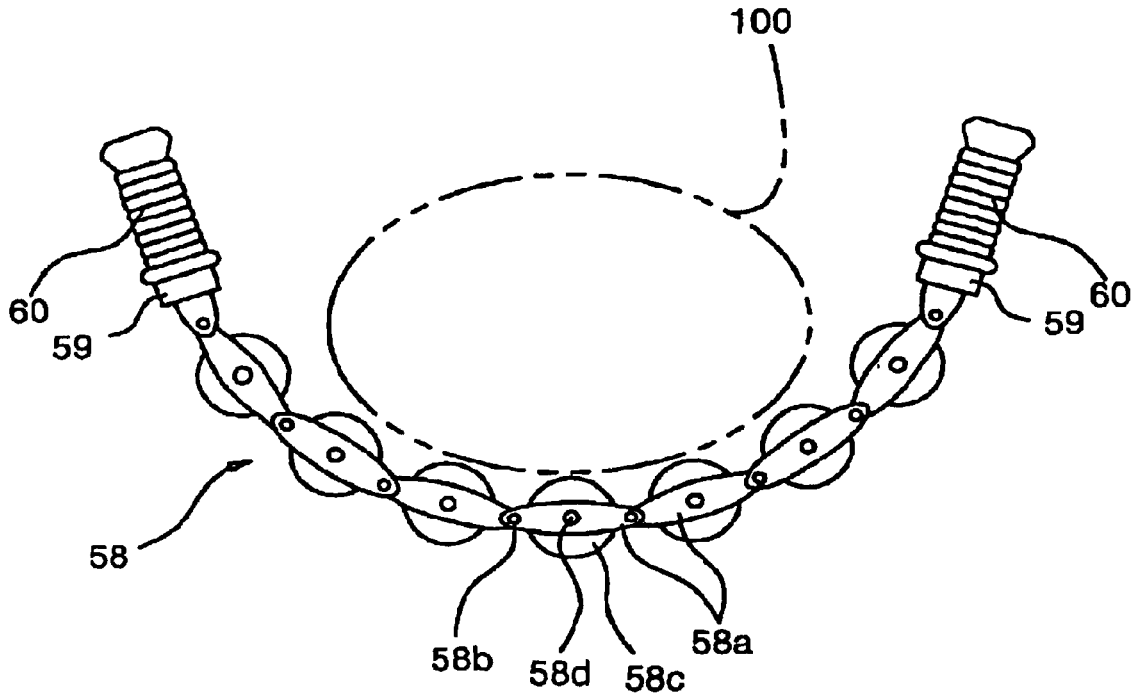

The roller members 58 illustrated in FIG. 8 may be also used. In other words, the roller members 58 assembled with the second hoop 54 by means of the nuts 59 as shown in FIG. 8 are separated from the second hoop 54 through the nuts 59 and thereafter the handles 60 are assembled with screws, whereby the roller members 58 are usable as the massaging unit as in FIG. 14.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

Industrial Applicability

As stated above, the present invention is comprised of a plurality of roller members being installed on a predetermined portion inside an overall circumference of a hoop and a weight member being installed on an opposite side to the center of the roller members to provide a centrifugal force to the hoop. As a result, it has an advantage of enabling exercise for a user's waist and lower part and also losing unwanted fat at the user's waist, sides and belly since the weight member is always located farthest from the user's body due to the centrifugal force of the weight member, and rollers are closely contacted with and rolled on the user's body while the user uses the hoop around his/her waist.

What is claimed is:

1. A hula hoop comprising:

a hoop;

a plurality of roller members being installed on a predetermined portion in an overall circumference of the hoop; and a weight member being installed on an opposite side to the center of the roller members to provide a centrifugal force and enable rollers comprised in the roller members to be closely contacted with and rolled on a user's body due to the centrifugal force.

2. The hula hoop of claim 1, wherein the roller members individually include inter-supports being fixed on the hoop and the roller being rotatably fixed on the inter-supports with a pin.

3. The hula hoop of claim 2, wherein the rollers comprised in the roller members are individually provided with pressure projections.

4. The hula hoop of claim 1, wherein contents of the weight member is water.

5. The hula hoop of claim 1, wherein contents of the weight member is sand.

6. The hula hoop of claim 1, wherein the roller members are separable from the hoop.

7. The hula hoop of claim 1, wherein the hoop is circular.

8. The hula hoop of claim 1, wherein the hoop is oval.

9. The hula hoop of claim 1, wherein the hoop is D-shaped.

10. The hula hoop of claim 1, wherein the hoop is usable as a massaging unit by separating a portion of the hoop containing the roller members from the hoop and installing handles on both ends of said portion.

11. A hula hoop comprising:

a hoop including a first hoop and a second hoop which are coupled with each other with length adjusting screws and being adjustable in circumferential size thereof;

a plurality of roller members being installed on the second hoop; and a weight member being installed on an opposite side to the center of the roller members which are installed on the second hoop to provide a centrifugal force to the hoop and enable rollers comprised in the roller members to be closely contacted with and rolled on a user's body due to the centrifugal force.

12. The hula hoop of claim 11, wherein the roller members form a chain by connecting a series of a pair of chain-type inter-supports with pins, and one roller is installed between the pair of chain-type inter-supports to be coaxially rotatable.

13. The hula hoop of claim 12, wherein the rollers comprised in the roller members are individually provided with pressure projections.

14. The hula hoop of claim 11, wherein contents of the weight member is water.

15. The hula hoop of claim 11, wherein contents of the weight member is sand.

16. The hula hoop of claim 11, wherein the roller members are separable from the hoop.

17. The hula hoop of claim 11, wherein the hoop is circular.

18. The hula hoop of claim 11, wherein the hoop is oval.

19. The hula hoop of claim 11, wherein the hoop is D-shaped.

20. The hula hoop of claim 11, wherein the hoop is usable as a massaging unit by separating the roller members from the hoop and installing handles on both ends of the roller members.

* * * * *

UNITED STATES PATENT AND TRADEMARK OFFICE

CERTIFICATE OF CORRECTION

PATENT NO. : 6,814,645 B2
DATED : November 9, 2004
INVENTOR(S) : Kuk

It is certified that error appears in the above-identified patent and that said Letters Patent is hereby corrected as shown below:

Title page,
Item [76], Inventor, delete
"72 Pung-Dong, Ilsan-Ku,
Koyang, 411-330 Kyounggi-Do (KR)" insert
-- 501-1703, Ilsan Pungdong 5-cha
Sangwon Ssantevill
1222, Pung-Dong, Ilsan-Ku Koyang
Kyounggi-Do 411-330 (KR) --

Signed and Sealed this

Twenty-second Day of February, 2005

JON W. DUDAS
*Director of the United States Patent and Trademark Office*